US007355132B1

(12) United States Patent
Rezac et al.

(10) Patent No.: US 7,355,132 B1
(45) Date of Patent: Apr. 8, 2008

(54) SIDE-MOUNTED LOCK-OFF ACCESSORY FOR A CIRCUIT BREAKER

(75) Inventors: Willard J Rezac, Cedar Rapids, IA (US); John M Winter, Cedar Rapids, IA (US); Antonio Zubieta, Nuevo Leon (MX)

(73) Assignee: Square D Company, Palatine, IL (US)

( * ) Notice: Subject to any disclaimer, the term of this patent is extended or adjusted under 35 U.S.C. 154(b) by 21 days.

(21) Appl. No.: 11/524,702

(22) Filed: Sep. 21, 2006

(51) Int. Cl.
*H01H 9/28* (2006.01)

(52) U.S. Cl. ..... 200/43.14

(58) Field of Classification Search ..... 200/43.01, 200/43.11–43.16, 43.19, 329–339
See application file for complete search history.

(56) References Cited

U.S. PATENT DOCUMENTS 4,260,861 A * 4/1981 DiMarco ..... 200/43.15
5,467,622 A * 11/1995 Becker et al. ..... 70/203
5,817,998 A * 10/1998 Siebels et al. ..... 200/43.14
6,791,040 B1 * 9/2004 Puhalla et al. ..... 200/43.14
6,940,027 B1 * 9/2005 Sipe ..... 200/43.14
6,992,256 B1 * 1/2006 Wiley et al. ..... 200/50.26

* cited by examiner

*Primary Examiner*—Elvin Enad
*Assistant Examiner*—M. Fishman

(57) ABSTRACT

A circuit breaker lock-off device is side-mounted to a circuit breaker case in a tenacious engagement. The lock-off device has a generally planar body carrying a lock-off arm pivotable in a plane parallel to the body to place an engagement tab extending therefrom into a position for preventing movement of the breaker handle without being physically attached to the breaker handle. The lock-off arm and the body further have complementary rings for accepting a padlock shackle in the locked off position. The invention allows a rugged lock-off accessory which is field installable and which can accommodate various breaker handle geometries.

16 Claims, 4 Drawing Sheets

SIDE-MOUNTED LOCK-OFF ACCESSORY FOR A CIRCUIT BREAKER

BACKGROUND OF THE INVENTION

1. Field of the Invention

The present invention relates to lock-off devices which can keep circuit breakers from being placed in the closed contact or ON positions allowing the flow of electricity therethrough.

2. Discussion of the Related Art

During electrical maintenance operations it is often required to de-energize the circuit being worked on. It is also often required that when a circuit breaker handle is moved to the OFF position to de-energize the circuit, a Lock Out or Tag Out procedure be performed whereby the circuit is prevented from accidentally being turned back on. Many examples of lock-off devices may be found in US Patent Class 200/subclass 14. However, it is believed that heretofore, most previous devices have suffered to some extent from one or more of the following conditions: having been mounted on the front, handle-containing, surface of the circuit breaker; relying on the shackle of the locking device for interference with the circuit breaker handle; and being adapted to deal only with an individual circuit breaker handle geometry.

SUMMARY OF THE INVENTION

The present invention provides a circuit breaker lock-off device which is an accessory which can be retrofitted to existing breakers or other accessories already attached to the breaker sides, as necessary. A lock-off device of the present invention is side-mounted to a circuit breaker case in a tenacious engagement to prevent rotation of the lock-off device, typically mechanically although adhesives of the like may be used. In some embodiments the lock-off device has a generally planar body, or body with a planar surface for mating with the circuit breaker case side. The body will carry a lock-off arm pivotable in a plane parallel to the body or side surface of the circuit breaker case, or both, to place an engagement tab extending therefrom into a position for preventing movement of the breaker handle. According to the present invention this may be done by placing the engagement tab in proximity to the breaker handle but without physical attachment to the breaker handle. The lock-off arm and the body further have structures, e.g. rings, with complementary apertures for accepting a securing device, such as the commonly used padlock, to prevent the engagement tab from being moved out of the locked off position. Among the advantages of the present invention, the side plate/side mount construction, and the engagement tab which need not physically contact the circuit breaker handle to achieve the lock-off, allow for a rugged lock-off accessory which is field installable and which can accommodate various breaker handle geometries.

In various embodiments the body of the lock-off device may be integrally molded, desirably of a clear polymer so as to not block markings on the side of the attached circuit breaker. The lock-off arm may be heat-staked at a first end thereof to the body to form a pivot point and have a biasing washer included therewith. The second end of the arm may include the complementary ring which can be secured around a boss on the body to prevent undesired movement of the arm such as may be needed in some mounting orientations of the circuit breaker.

Also formed on the body may be a plurality of engagement hooks or other means for engaging with the circuit breaker case. In some embodiments, the hooks can be sized and placed to engage with mating recesses already formed in the circuit breaker case. Further, the hooks can be designed to fracture after being engaged with the circuit breaker case and removal of the body is attempted at a predetermined force, thereby providing evidence of tampering or unauthorized removal of the device. The body may further have an alignment tab for preventing rotation of the body about an axis parallel to the circuit breaker handle axis of rotation.

DETAILED DESCRIPTION OF THE CURRENT EMBODIMENT

Figure 1:
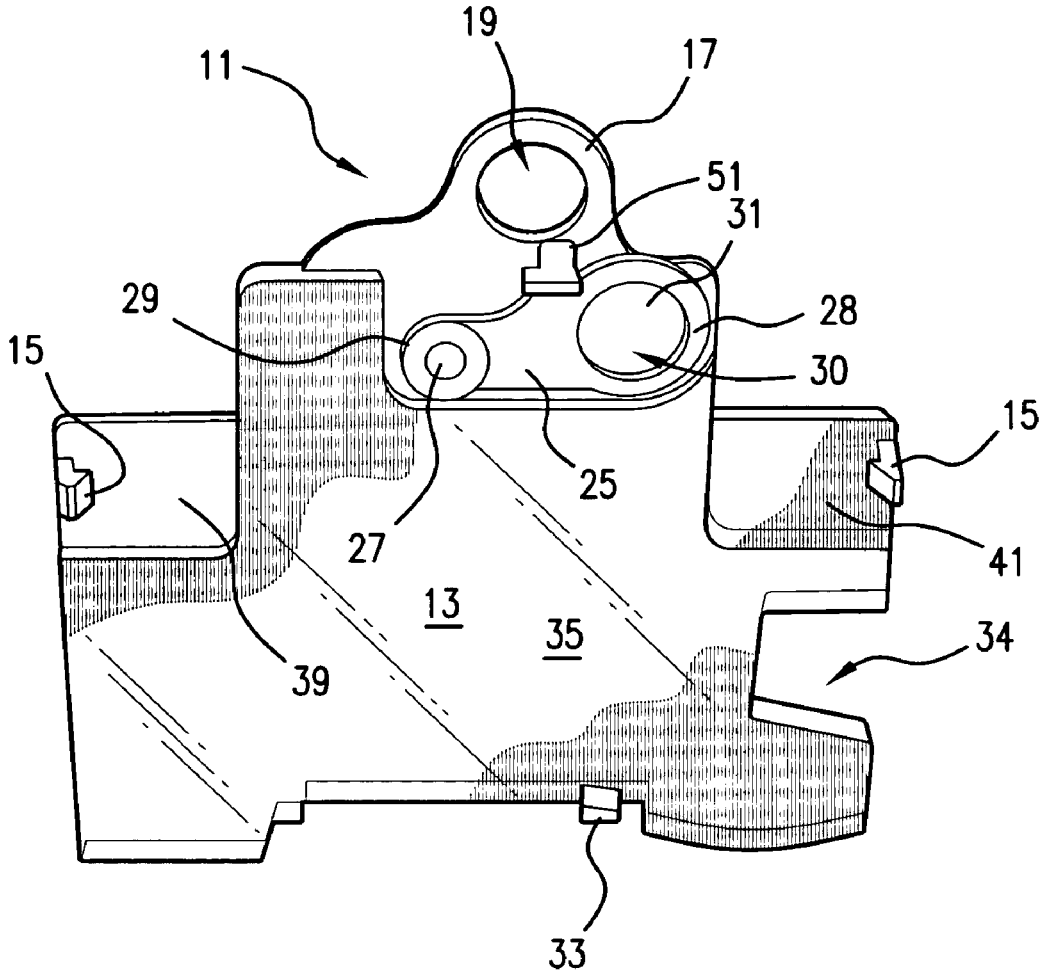
FIG. 1 is an elevation of an exemplary lock-off device according to one embodiment of the present invention from the side for facing the circuit breaker.
Figure 3:
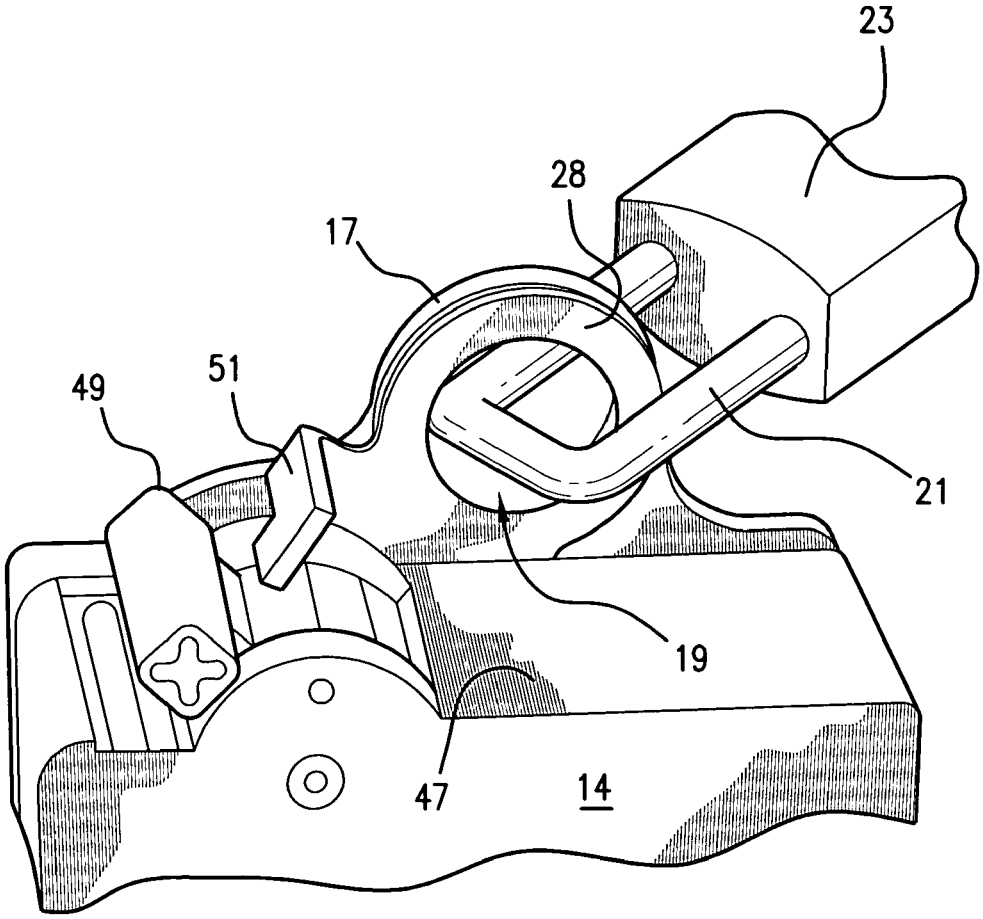
FIG. 3 illustrates the lock-off device in the operable position preventing a circuit breaker handle from being moved to an ON position and locked in place by a padlock.
Figure 4:
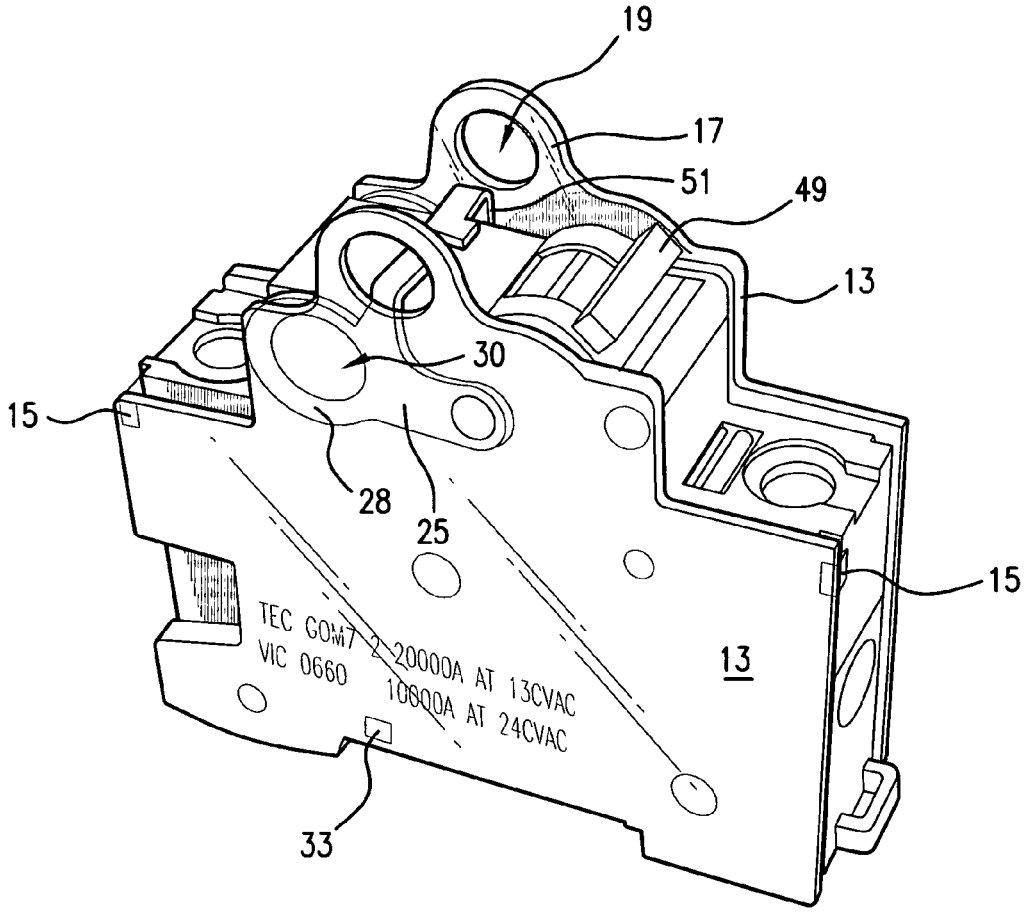
FIG. 4 is a side perspective view similar to FIG. 2 illustrating both right side and left side lock-off devices on either side of and attached to a circuit breaker with the retention arms in the non-operable non-lock-off positions.

Referencing the drawings, and especially FIG. 1, exemplary embodiments of the lock-off device 11 of the present invention are shown. The lock-off device 11 comprises a body 13, having means, collectively 15, for mounting the body 13 to a circuit breaker 14. The body has a ring 17 or other substantially annular structure forming a throughhole or aperture 19 being sized for accepting a securing device such as the shackle 21 of a padlock 23 (FIG. 3). A lock-off arm 25 is pivotally attached to the body 13 by a securing nub 27 and has a complementary ring 28 with an annular void 30. A biasing washer 29 is fitted between the nub 27 and the lock-off arm 25 to bias the lock-off arm 25 towards the body 13. An arm retention nub 31 for frictionally retaining the complementary ring 28 is formed on the body 13. An alignment tab 33 also extends from the body 13.

Figure 2:
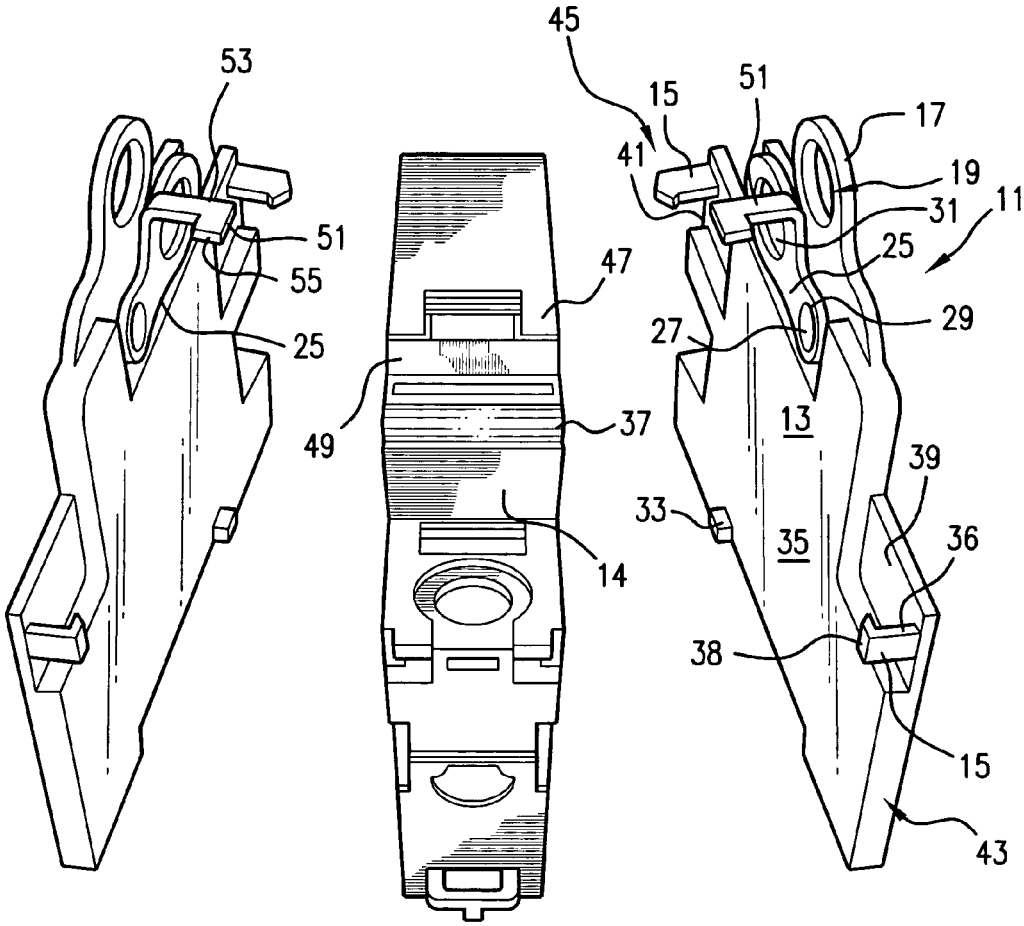
FIG. 2 illustrates front perspective views of both right side and left lock-off devices on either side of a circuit breaker but not attached thereto.

The body 13 has a generally planar surface 35 for abutting a side wall 37 (FIG. 2) of the circuit breaker 14. The body 13 and its respective parts are desirably molded from a nonconductive thermoplastic or clear polycarbonate resin so as to not obstruct any side markings on the circuit breaker 14 or other accessory attached thereto. Other materials may be suitably used according to the parameters of the invention as would be understood by those of skill in the art. Desirably the body is not more than one quarter the thickness of its associated circuit breaker case, such that the mounting of every four circuit breakers with attached lock-off accessories would only take the space of five circuit breakers on a distribution rail. Beyond this, consideration must be given to the trade off between strength and flexibility of the body 13 in accomplishing the side mounting and lock-off functionality of the present invention. Likewise, the overall shape of the body 13, such as including the back side cutout 34 for termination clearance for connections to the circuit breaker 14, will be determined by the overall considerations of the circuit breaker 14 and lock-off device 11 functionality when placed in combination. The body 13 has first and second areas of reduced thickness 39, 41 respectively, at front and back ends 43, 45, respectively, of the body 13, for allowing flexure of the body 13 to seat the means 15 for mounting, which extend therefrom, onto the circuit breaker 14. The body ring 17 extends upwardly from the body 13 to place it substantially above the surface 47 of the circuit breaker 14 bearing its handle 49.

The exemplary means 15 for mounting the planar surface 35 of the body 13 to a side wall 37 of the circuit breaker 14, are arms 36 with tabs, or hooks, 38 desirably for engaging the corners or preformed recesses (not shown) in the case of the circuit breaker 14, and will generally result in a tenacious engagement and positioning of the body 13 with the circuit breaker 14. Alternatively, adhesives or other means for mounting may be suitably used according to the parameters of the invention as would be understood by those of skill in the art. In some embodiments the exemplary hooks are designed, i.e., the size, shape, and materials are selected, to be frangible so as the fracture if the lock-off device 11 is attempted to be removed above a predetermined force, thus evidencing improper interference with the function of the lock-off device 11.

The lock-off arm 25 is pivotally attached to the body 13 such as by heat staking the securing nub 27. The lock-off arm 25 carries an engagement tab 51 attached thereto which extends inwardly from the body 13 in a direction to be placed over the handle surface 47 of the circuit breaker 14 and in interference with the circuit breaker handle 49 when the lock-off arm 25 is in operable position as shown in FIG. 3 thus preventing movement of the circuit breaker handle 49 from the OFF position (shown) to the ON position. When the lock-off arm 25 is pivoted, in the exemplary embodiment roughly sixty degrees, into the non-operable, non-lock-off position, the engagement tab 51 rests on top of the circuit breaker 14 out of the way of the handle 49 as placed in the ON position. The complementary ring 28 of lock-off arm 25 is also desirably substantially hidden between the body 13 and the circuit breaker 14 and substantially beneath the handle-bearing surface 47 of the circuit breaker 14.

The engagement tab 51 is shown as a generally "L"-shaped arm with a long leg 53 extending inwardly and perpendicular from the body 13 and a short leg 55 extending perpendicularly from the long leg 53 toward the circuit breaker handle 49. However, the engagement tab 51 may otherwise be suitably sized and shaped according to the dictates of the breaker application. Considerations of engagement tab 51 size and shape, location of the pivot point, circuit breaker handle geometries to be accommodated, and any other associated circuit breaker accessory attachment layouts, may all affect the design of the engagement tab 51.

Referencing especially FIG. 3, the lock-off arm 25 in the operable position will have its complementary ring 28 adjacent to the body ring 17 for concurrently accepting the shackle 21. The engagement tab is thus placed in a position to prevent the circuit breaker handle from moving to an ON position and securable in said position by the shackle 21 or other securing device being placed concurrently through the complementary ring 28 and the body ring 17. In the exemplary embodiment it will be understood that the engagement arm 51 cannot be placed and locked in a position to maintain the circuit breaker 14 in an ON position. However, in alternative embodiments, the analogous pivot point of the lock-off arm, the geometry and placement of the voids for the body ring and the lock-off arm ring, and location and shape of the engagement arm, may be modified to allow such alternative embodiments to encompass both of a lock-off and a lock-on functionality is such is desired. The lock-off arm 25, including engagement arm 51, may be made of stainless steel or other suitable materials. The biasing washer 29, such as a Bellevue washer or the like, may be applied before the heat staking of the securing nub 27 and likewise made of stainless steel or other suitable materials.

Having thus described a side mounted lock-off device for a circuit breaker; it will be appreciated that many variations thereon will occur to the artisan upon an understanding of the present invention, which is therefore to be limited only by the appended claims.

We claim:

1. A circuit breaker lock-off device comprising:

a) a body with a generally planar surface for abutting a side wall of a circuit breaker;

b) means for mounting the planar surface of the body to a side wall of a circuit breaker case in a tenacious engagement;

c) the body having an aperture sized and located for accepting a securing device when the body is placed in tenacious engagement with the circuit breaker;

d) a lock-off arm pivotally attached to the body;

i) an engagement tab attached to the lock-off arm and extendable over a handle surface of the circuit breaker;

ii) the lock-off arm further having a complementary aperture to the aperture of the body for also accepting the securing device; and e) whereby the engagement tab is placed in a position to prevent the circuit breaker handle from moving to an ON position when the complementary aperture and the aperture of the body are placed in an adjacent position allowing the securing device to be placed concurrently therethrough.

2. A circuit breaker lock-off device comprising:

a) a body with a generally planar surface for abutting a side wall of a circuit breaker;

b) means for mounting the generally planar surface of the body to a side wall of a circuit breaker case in a tenacious engagement;

c) the body having a ring being sized for accepting a securing device and extending at least in part above a handle surface of the circuit breaker when the body is placed in tenacious engagement with the circuit breaker;

d) a lock-off arm attached to the body and pivotable in a plane parallel to the generally planar surface of the body;

i) the lock-off arm having an engagement tab extendable over the handle surface of the circuit breaker;

ii) the lock-off arm further having a complementary ring to the ring of the body for accepting a securing device; and e) whereby the engagement tab is placeable in a position to prevent the circuit breaker handle from moving to an ON position without being physically attached to the breaker handle and the complementary ring and the body ring may have the securing device placed therethrough to maintain the circuit breaker in the OFF position.

3. The circuit breaker lock-off device of claim 2 wherein the securing device is a padlock shackle.

4. The circuit breaker lock-off device of claim 2 further comprising: the body having means for holding the lock-off arm in a nonoperative position.

5. The circuit breaker lock-off device of claim 2 further comprising: the body having a member for biasing the lock-off arm to the body.

6. The circuit breaker lock-off device of claim 2 further comprising: the body further having an alignment tab for preventing rotation of the body about an axis parallel to the lock-off arm axis of rotation.

7. The circuit breaker lock-off device of claim 2 further comprising: the body further having a plurality of mounting means for engaging with the circuit breaker case.

8. The circuit breaker lock-off device of claim 7 wherein the mounting means are hooks sized and placed to engage with mating recesses in the circuit breaker case.

9. The circuit breaker lock-off device of claim 7 further comprising: the body further having the hooks shaped and sized to fracture after being engaged with the circuit breaker case and removal of the body is attempted above a predetermined force.

10. The circuit breaker lock-off device of claim 2 further comprising: at least parts of the body further being sufficiently flexible to allow for flexure to ease the body into a snap-on position over the circuit breaker side wall.

11. The circuit breaker lock-off device of claim 2 further comprising: the body further being translucent to allow viewing the circuit breaker side wall.

12. The circuit breaker lock-off device of claim 2 further comprising: the body further being one quarter or less the thickness of the circuit breaker.

13. The circuit breaker lock-off device of claim 2 further comprising: the arm being stainless steel.

14. The circuit breaker lock-off device of claim 5 further comprising: the member for biasing being a biasing washer.

15. The circuit breaker lock-off device of claim 2 further being attached to a circuit breaker.

16. A circuit breaker lock-off device comprising:

a) a generally planar body, the body having a ring being sized for accepting a padlock shackle and extending above a circuit breaker handle-bearing surface;

b) means for mounting the planar surface of the body to a side wall of a circuit breaker case in a tenacious engagement;

c) a lock-off arm attached to the body and pivotable in a plane parallel to the body;

i) the lock-off arm having an L-shaped engagement tab with a first leg of the L extending perpendicularly from the lock-off arm and with a second leg of the L being a tab extending towards the breaker handle;

ii) the lock-off arm being pivotable into a position for preventing movement of the breaker handle, iii) the lock-off arm further having a complementary ring to the ring of the body for accepting a padlock shackle; and d) whereby the engagement tab is in a position to prevent the circuit breaker handle from moving to an ON position without being physically attached to the breaker handle in the locked off position.

* * * * *